US005298011A

United States Patent [19]

Krasuski

[11] Patent Number: 5,298,011

[45] Date of Patent: Mar. 29, 1994

[54] ADJUSTMENT DEVICE FOR ADJUSTING THE FOLD DIMENSION OF DOCUMENTS, IN PARTICULAR FOR A FOLDING MACHINE HAVING POCKETS

[75] Inventor: Marek Krasuski, Fontenay Aux Roses, France

[73] Assignee: Alcatel Satmam, Bagneux, France

[21] Appl. No.: 811,663

[22] Filed: Dec. 23, 1991

[30] Foreign Application Priority Data

Dec. 28, 1990 [FR] France ..... 90 16472

[51] Int. Cl.[5] ..... B65H 45/14

[52] U.S. Cl. ..... 493/420; 493/476

[58] Field of Search ..... 493/419, 420, 421, 476

[56] References Cited

U.S. PATENT DOCUMENTS

| | | | |
|---|---|---|---|
| 3,711,085 | 1/1973 | Bunch, Jr. | 493/419 |
| 3,856,293 | 12/1974 | Boyer | 493/421 |
| 4,518,380 | 5/1985 | Shimizu | 493/420 |
| 4,585,219 | 4/1986 | Lehmann | 493/419 |
| 5,180,357 | 1/1993 | Marzullo | 493/421 |

FOREIGN PATENT DOCUMENTS 1564392 4/1969 France .

*Primary Examiner*—Jack Lavinder
*Attorney, Agent, or Firm*—Sughrue, Mion, Zinn, Macpeak & Seas

[57] ABSTRACT

The present invention relates to an adjustment device for adjusting the position of a fold abutment provided so as to be movable in translation along a shaft fixed on a guide plate for guiding a document to be folded. This adjustment device comprises an actuator device and a transmission device for transmitting the displacement of the actuator device to the abutment, which transmission device is constituted by a looped cable kept taut by three pulleys, with one straight portion of the cable being parallel to the side edge of the plate and connected to the abutment, and with another straight portion of the cable being connected to the actuator device.

4 Claims, 3 Drawing Sheets

ADJUSTMENT DEVICE FOR ADJUSTING THE FOLD DIMENSION OF DOCUMENTS, IN PARTICULAR FOR A FOLDING MACHINE HAVING POCKETS

The invention relates to an adjustment device for adjusting the position of a fold abutment provided so as to be movable in translation along a shaft fixed on a guide plate for guiding the document to be folded.

In particular, this device is designed for adjusting the fold dimensions in a folding machine having two pockets.

BACKGROUND OF THE INVENTION

A known adjustment device for adjusting the abutments in a large-size high-rate folding machine consists of an arrangement of strips. Each strip carries an abutment and may be manually moved in translation along rails provided on the longitudinal edges of the document guide plates. The abutment is adjusted by displacing the strip and locking it in the desired position.

This type of device requires sufficient free space for providing access to the strips. In compact and medium-size folding machines, the amount of free space available is such that it is impossible or difficult to insert a hand so as to access the abutment.

Moreover, folding machines are often associated with mechanisms for inserting the document into an envelope and for closing the envelope, which mechanisms require space in the machine and reduce the availability of access to the various portions of the folding machine.

A folding machine having pockets is described in French Patent Application 90 13580. Such a folding machine includes a top pocket for making a first fold, and a bottom pocket for making a second fold. Each pocket includes a fixed plate and a central plate that moves.

Each of the central plates supports an abutment which is adjustable in translation along its pocket, so as to select the positions of the first and second folds in the document. Such a folding machine is designed to be followed by a mechanism for inserting the document into an envelope and for closing the envelope.

An aim of the invention is to provide an adjustment device for adjusting the positions of the abutments, in particular for such a machine, with the access and maneuverability of the adjustment device being particularly practical and reliable.

SUMMARY OF THE INVENTION

To this end, according to the invention, the adjustment device comprises an actuator device and a transmission device for transmitting the displacement of the actuator device to the abutment, which transmission device is constituted by a looped cable kept taut by three pulleys carried by the plate, with one straight portion of the cable being parallel to the side edge of the plate and connected to the abutment, and with another straight portion of the cable being connected to the actuator device.

In this way, appropriate positioning the actuator device makes it is easily accessible, and transmission is particularly reliable and simple.

In a first arrangement, the actuator device is disposed on a tray which is fixed relative to the plate and which is disposed parallel to the front edge of the plate. In this way, manual adjustment of folding is possible, since the tray(s) is/are particularly visible and accessible when the folding machine is open.

In a second arrangement, the actuator device is a micromotor connected to the cable. In this way, motorized adjustment of the abutment may be effected.

The micro-motor may be controlled directly from the keyboard of the machine, and adjustment can be effected without the machine being opened.

A device of the invention is, in particular, designed to equip a folding machine having two pockets such as the machine described in French Patent Application 90 13580. In particular, the two actuator devices may be disposed on a common tray which is fixed relative to the two central plates of the pockets, and which is disposed parallel to the front edge of each plate.

BRIEF DESCRIPTION OF THE DRAWINGS

An embodiment of the invention is described below in more detail with reference to the accompanying drawings, in which.

DETAILED DESCRIPTION

Figure 1:
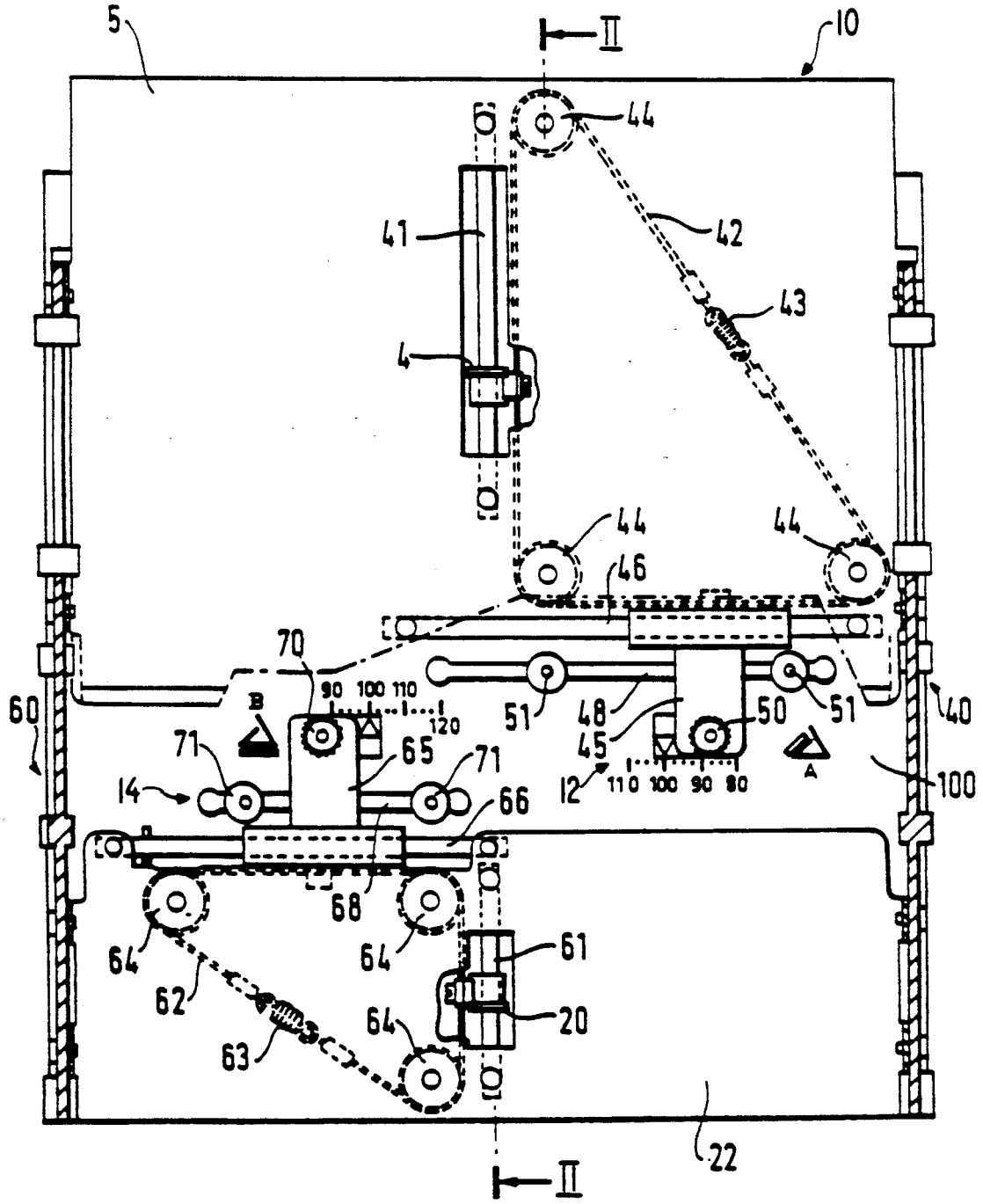
FIG. 1 is a developed front view of the central plates of two pockets of a folding machine, with each pocket being equipped with an adjustment device of the invention.

FIG. 1 is a view (which is developed so as to offer a fuller view) showing the bottom plate 5 of the first pocket and the top plate 22 of the second pocket of a folding machine, indicated generally at 10 FIG. 1. The actual disposition of these plates 5 and 22 is shown in FIG. 2.

Figure 2:
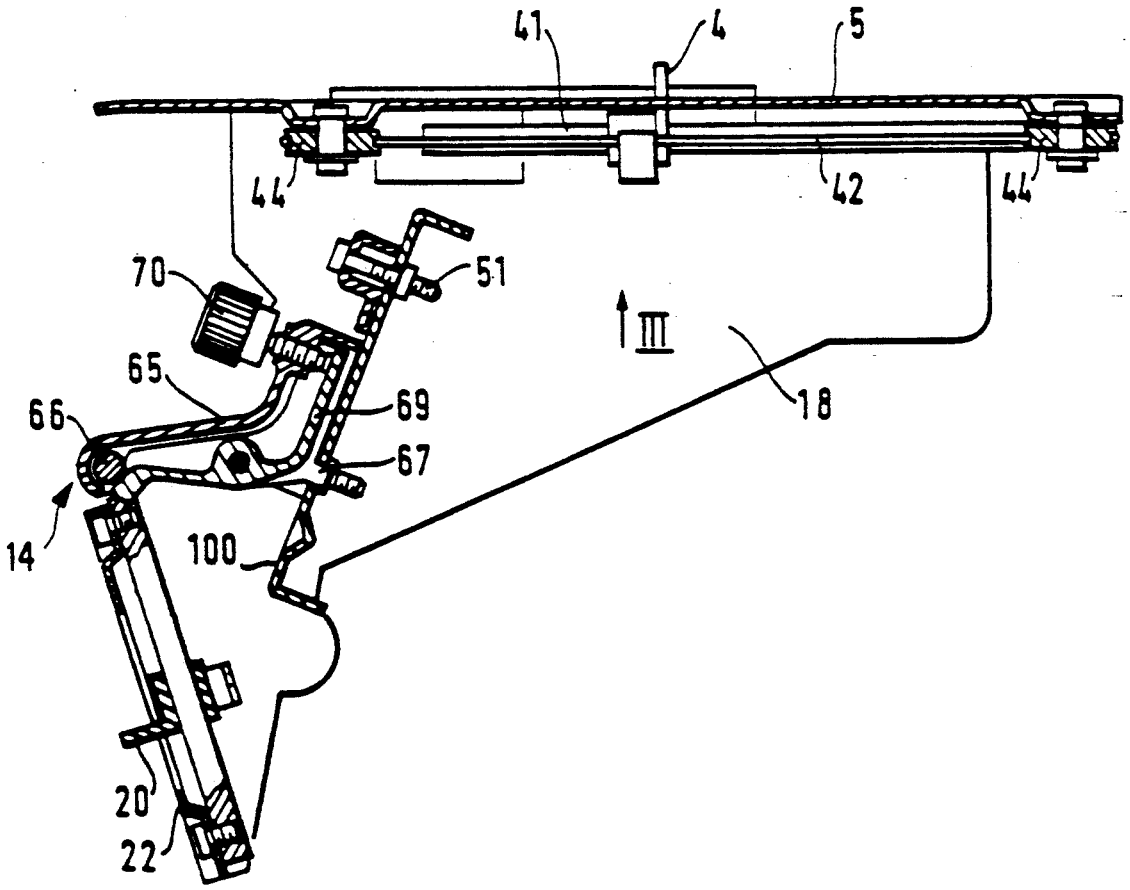
FIG. 2 is a larger scale section on II—II, with the plates being shown in their actual disposition.
Figure 3:
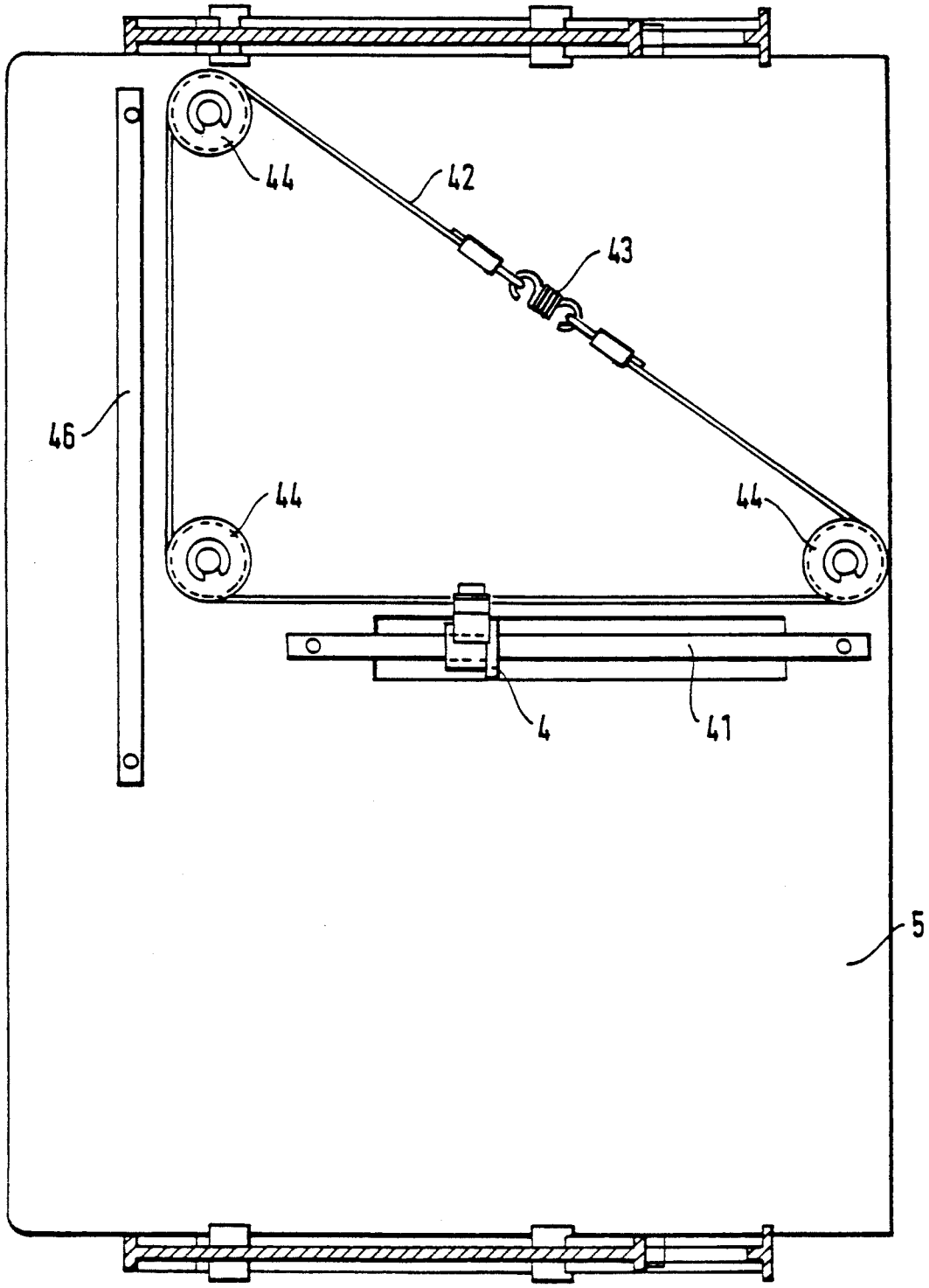
FIG. 3 is a plan view on III of the transmission device with which the central plate of the top pocket is equipped.

In the embodiment shown, these two plates are connected together at their sides by two panels 18, one of which is shown in FIG. 2. A tray 100 is fixed on one side of the panels which tray supports both the actuator device indicated generally at 12 for actuating the adjustment device 40 for a adjusting the abutment 4 of the first pocket and also the actuator device indicated generally at 14 for actuating the adjustment device 60 for adjusting the abutment 20 of the second pocket. These two devices are identical in construction.

More generally, and in the event of the plates 5 and 22 being arranged differently, each of the plates 5 and 22 may be provided with its own tray 100, one tray being fixed relative to plate 5, and the other tray being fixed relative to the other plate 22.

Each abutment 4, 20 is slidably mounted on a shaft 41, 61 fixed by its ends to the corresponding plate 5, 22. The abutment 4, 20 projects in the form of a tab from the working face of the plate 5, 22 via a slot provided therein.

The abutment 4, 20 is fixed to a looped cable 42, 62, the ends of the cable being connected together by a spring 43, 63 interposed so as to obtain correct tension. The cable 42, 62 is wound round three pulleys 44, 64 disposed so that a portion of the cable is parallel to the trajectory of the abutment, i.e. parallel to the side edges of the plate, and so that another portion of the cable is parallel to the front edge of the plate and in the proximity of said front edge.

The actuator device for actuating the transmission device constituted by the cable and pulleys system is fixed to this second straight portion of the cable.

Each actuator device, 12, 14 includes a carriage 45, 65. This carriage slides on a shaft 46, 66 fixed to the plate parallel to and in the proximity of the front edge thereof. The carriage 45, 65 is further guided by a projecting portion 67 projecting through a slot 48, 68 provided in the tray 100.

The carriage 45, 65 has an inside portion 69 which is hinged on the main portion of the carriage. The inside portion 69 grips the shaft 46, 66 under the action of a pressure screw 50, 70.

Two moving abutment pegs 51, 71 are provided in respective slots 48, 68, which abutment pegs can be positioned manually. A graduated scale is disposed to cooperate with a marker on the carriage 45, 65.

The adjustment devices 40,60 are used as follows.

Device 40 is used for adjusting the length of the first fold in the document and device 60 is used for adjusting the length of the second fold in the document.

For each adjustment device, two preselected settings are made possible by means of the abutment pegs 51, 71. When the user is principally concerned with two lengths of fold, the two pegs 51, 71 are set prior to the folding machine being supplied. In this way, the user merely has to displace the carriage 45, 65 until it abuts against one or other of the pegs 51, 71.

For other settings, the marker on the carriage is brought to the desired position on the corresponding scale.

The carriage is displaced by loosening the pressure screw 50, 70, moving the carriage in translation, and then tightening the screw 50, 70 again, the hinged inside portion 49, 69 then gripping the shaft 46, 66 and locking the carriage.

Displacing the carriage 45 65 to the right or to the left causes the corresponding abutment 5, 20 to be displaced forwards or backwards, and thus reduces or increases the length of the corresponding fold in the document.

In a variant embodiment, the above-described manual actuator device may be replaced by a motorized actuator device. In which case, a micro-motor associated with a sensor is preferably installed on the plate. By means of a suitable adequate mechanism, the rotation of the motor is transformed into translation of the cable which transmits the displacement to the abutment.

I claim:

1. In a folding machine having a folding pocket guide plate for guiding a material to be folded along a feed direction from a front edge of said guide plate to an abutment spaced therefrom which stops said material at a stop location, said abutment being slidably mounted on a first face of said guide plate, the improvement comprising;

transmission means for moving said abutment along said feed direction for adjusting the stop location, said transmission means comprising:

first, second and third pulleys rotably mounted on a second face of said guide plate opposite to said first face, said first and second pulleys being spaced apart from each other along said feed direction, said second pulley being nearer to said front edge of the guide plate than the first pulley, said second and third pulleys being spaced apart from each other along the front edge of the guide plate, and at right angles to a plane defined by said first, and second pulleys, a looped cable led over said first, second and third pulleys, means for keeping said looped cable taut, said abutment projecting through a slot provided in said guide plate and gripping a first straight portion of said cable extending between said first and second pulley, a tray disposed in the proximity of the front edge of said guide plate, an actuator device slidably mounted on said tray for movement in a direction parallel to the front edge of said guide plate, and said actuator device including means coupled to a second straight portion of said cable for driving in translation said second straight portion of the cable between said second and third pulley to cause the displacement of said abutment in the material feed direction.

2. The folding machine according to claim 1, wherein the actuator device comprises a carriage slidably mounted in a slot provided in said tray and extending parallel to the front edge of the guide plate, and wherein a graduated scale extends along said slot within said tray for indicating the displacement of the carriage to thereby represent a material folding size.

3. The folding machine according to claim 2, further comprising at least one abutment peg disposed in said slot of said tray for movement in translation along the slot of said tray and locking means for releasably locking said abutment peg at a selected position within said slot upon termination in translation of said peg.

4. The folding machine according to claim 3, wherein said carriage is slidably mounted on a shaft fixed to said guide plate and extending parallel to the front edge of said guide plate, and means carried by said carriage for selective grip or release of said shaft.

* * * * *